US005673053A

United States Patent [19]

Marthinsson

[11] Patent Number: 5,673,053

[45] Date of Patent: Sep. 30, 1997

[54] ANTENNA COUPLING DEVICE FOR COUPLING AN ANTENNA OF A HAND-PORTABLE TELEPHONE TO A REMOTELY LOCATED ANTENNA

[75] Inventor: Magnus Marthinsson, Åkersberga, Sweden

[73] Assignee: Allgon AB, Akersberga, Sweden

[21] Appl. No.: 600,995

[22] PCT Filed: Aug. 24, 1994

[86] PCT No.: PCT/SE94/00771

§ 371 Date: Mar. 5, 1996

§ 102(e) Date: Mar. 5, 1996

[87] PCT Pub. No.: WO95/07556

PCT Pub. Date: Mar. 16, 1995

[30] Foreign Application Priority Data

Sep. 6, 1993 [SE] Sweden ..... 9302870

[51] Int. Cl.[6] ..... H01Q 1/24; H01Q 1/32

[52] U.S. Cl. ..... 343/728; 343/702; 343/715

[58] Field of Search ..... 343/866, 715, 343/713, 711, 712, 714, 725, 726, 728, 729, 702; H01Q 21/00, 1/24, 1/32

[56] References Cited

U.S. PATENT DOCUMENTS

| | | | |
|---|---|---|---|
| 2,202,368 | 5/1940 | Berndt | 343/866 |
| 2,953,782 | 9/1960 | Byatt | 343/726 |
| 3,882,506 | 5/1975 | Mori et al. | 343/728 |
| 4,220,955 | 9/1980 | Frye | 343/703 |
| 4,407,000 | 9/1983 | Sasaki et al. | 343/726 |
| 5,099,252 | 3/1992 | Bryant et al. | 343/713 |
| 5,181,043 | 1/1993 | Cooper | 343/713 |
| 5,274,388 | 12/1993 | Ishizaki et al. | 343/725 |
| 5,300,936 | 4/1994 | Izadian | 343/728 |
| 5,357,262 | 10/1994 | Blaese | 343/702 |

FOREIGN PATENT DOCUMENTS 2266997 11/1993 United Kingdom .

*Primary Examiner*—Hoanganh T. Le

*Attorney, Agent, or Firm*—Jacobson, Price, Holman & Stern, PLLC

[57] ABSTRACT

An antenna coupling device is disclosed for connecting, substantially inductively, a first antenna to a second antenna, whereat the antenna coupling device comprises a loop antenna (4) with two poles (15, 16). The loop antenna (4) is arranged to surround the first antenna and is connected to the second antenna via both of its poles (15, 16). Such an antenna coupling device connected via a cable (5) to an external antenna by the action of threading the antenna coupling device onto a helical antenna (2) of a hand-portable telephone (1) is used inside a vehicle for improving transmission and reception conditions of the hand-portable telephone (1).

14 Claims, 1 Drawing Sheet

ANTENNA COUPLING DEVICE FOR COUPLING AN ANTENNA OF A HAND-PORTABLE TELEPHONE TO A REMOTELY LOCATED ANTENNA

BACKGROUND OF THE INVENTION

The invention relates to an antenna coupling device for coupling, substantially inductively, a first antenna, e.g., situated in a vehicle and, e.g., incorporated in a hand-portable telephone, to a second antenna.

Specifically, the invention relates to an antenna coupling device for coupling inductively a first antenna, situated in a screened place, to a second antenna, working under better transmission and reception conditions. Such an antenna coupling device may be used, e.g., when travelling in a vehicle for applying onto a helical antenna of a hand-portable telephone, which is not provided with means for a galvanical connection to an external antenna. The telephone may hereby be coupled inductively via an RF coupling means and a coaxial cable to an external antenna for achieving better antenna performance.

An antenna coupling device of this kind is disclosed in U.S. Pat. No. 4 220 955, which describes a device for coupling inductively an antenna, which is incorporated in a "transceiver", to an external antenna. The coupling device comprises a shielded housing intended to be threaded onto the antenna and containing an helical antenna in the form of a coil for the inductive coupling.

An isolated sleeve with an open end carries the coil, the one end of which is connected to the center conductor of a transmission line, which leads to an external device, and the second end of which is open. The coil and the sleeve are surrounded by a conductive housing, which is coupled to the shield of the transmission line.

The above antenna coupling device is distinguished by the use of a helical antenna, i.e. a coil with one open end, for the inductive coupling. Further, the diameter of the coil is small in relation to the transferred wavelengths. This means that the helical antenna is functioning in "normal mode". Such is also the case for the helical antenna built in the "transceiver". Hereby the short range radiation fields of the electromagnetic radiation of the two antennas correspond, which is one of the conditions for satisfactory inductive coupling, when the antennas have the same geometrical orientation and are situated close to each other.

In order to achieve satisfactory inductive coupling in this prior art antenna coupling device, the helical antenna must also be provided with a relatively large number of turns, in respect to its required diameter and total wire length, and the turns must be distributed spaciously, i.e. the helical antenna shall have a large axial elongation.

If the helical antenna is to be compressed axially through a more compact winding this may to some extent be compensated by a greater number of turns, which requires a more complicated design and creates difficulties in achieving the same efficiency.

SUMMARY OF THE INVENTION

The object of the invention is to achieve an antenna coupling device that overcomes as far as possible the above mentioned drawbacks and that fulfills the demands of a high degree of coupling, simple and compact design, and uncomplicated operating.

A loop antenna has other features than a helical antenna. The loop antenna works by both its ends, or poles, being galvanically coupled. Hereby it presents another radiation pattern or field. However, in the immediate proximity of antennas of the different types, i.e. within the short range fields, the radiation patterns are approximately the same. This enables a loop antenna to be designed to give excellent inductive coupling to a helical antenna, provided that these have the same geometrical orientation and that the loop antenna preferably surrounds the helical antenna.

Further, it is advantageous to use a loop antenna, since it gives a high degree of efficiency for the inductive coupling with a very simple design. An electrically well-dimensioned loop antenna including a well-tuned impedance matching unit may in one single turn give a degree of efficiency of 50–70%. Hereby the loop antenna may be given an exceptionally small size and an easily adapted design. With this solution it is also possible to achieve an extremely broad-banded antenna function.

It is also possible to provide the loop antenna with more than one turn. This way one could, e.g., achieve an impedance matching to a cable without the use of separate reactive elements or tuned conductor elements in connection with the loop antenna.

Thus, the object of the invention is achieved by an antenna coupling device of the outlined type, said antenna coupling device comprising a loop antenna with two poles, the loop antenna being arranged to surround a first antenna, and the loop antenna being connected, via both its poles, to the second antenna.

It is advantageous that the loop antenna is connected to the second antenna via an impedance matching unit, which is coupled directly to the loop antenna. Hereby the impedance of the loop antenna may easily be adapted to an arbitrary impedance, irrespective of the diameter and the number of turns of the loop antenna and irrespective of the frequency range used for transmitting and receiving.

It is also possible to connect the impedance matching unit via a cable at some distance from the loop antenna. However, this decreases the degree of efficiency as a result of a high standing wave ratio in the cable.

Further, it is suitable to connect the loop antenna to the second antenna via a transmission line in order to freely place the antenna coupling device and the second antenna, respectively, in suitable positions. For example, the antenna coupling device may for this purpose be made easily accessible inside a vehicle for a user of a hand-portable telephone, whereat the second antenna may be mounted externally on the vehicle body.

In this case, the impedance matching unit adapts the loop antenna to the impedance of the transmission line, so that the least possible losses occur and the highest possible degree of efficiency is achieved. It is advantageous to choose a coaxial cable as the transmission line, since it is well-suited for transferring RF signals.

In a preferred embodiment of the invention, the second antenna is a monopole or dipole antenna, which is in principle an RF radiating, straight conductor, or a co-linear antenna, constituted by two or more monopoles with a coil arranged between adjacent monopoles.

In order to achieve satisfactory coupling, or high degree of efficiency, the loop antenna is arranged to surround or enclose the first antenna substantially coaxially with a small mutual radial separation.

In the first preferred embodiment, the loop antenna and the impedance matching unit are arranged within a housing that may be threaded onto the first antenna and that arranges the loop antenna substantially coaxially to the first antenna. Preferably, the housing is non-conductive, although it may be made of conductive or metallized material, whereby it may be connected to the shield of the coaxial cable.

The housing is provided with at least one mechanical fixing means for fastening onto the first antenna. The mechanical fixing means may interlock with a groove or a shoulder, be clamped or screwed either onto the first antenna or onto the hand-portable telephone itself.

Another important advantage in the use of a loop antenna is that it may easily be arranged on a printed circuit board together with the impedance matching unit.

Further advantageous features of the invention are described in the dependent claims.

The invention allows several modifications without departing from its main principles. For example, the antenna coupling device may be used for coupling inductively a first antenna to any type of RF means.

BRIEF DESCRIPTION OF THE DRAWINGS

The invention is described closer below in a preferred embodiment with references to the accompanying drawings, wherein.

DESCRIPTION OF THE PREFERRED EMBODIMENTS

In the preferred embodiment the antenna coupling device is used inside a vehicle or a building for coupling inductively a hand-portable telephone to an external antenna, which hand-portable telephone is not provided with means for a galvanical connection to an external antenna.

Figure 1:
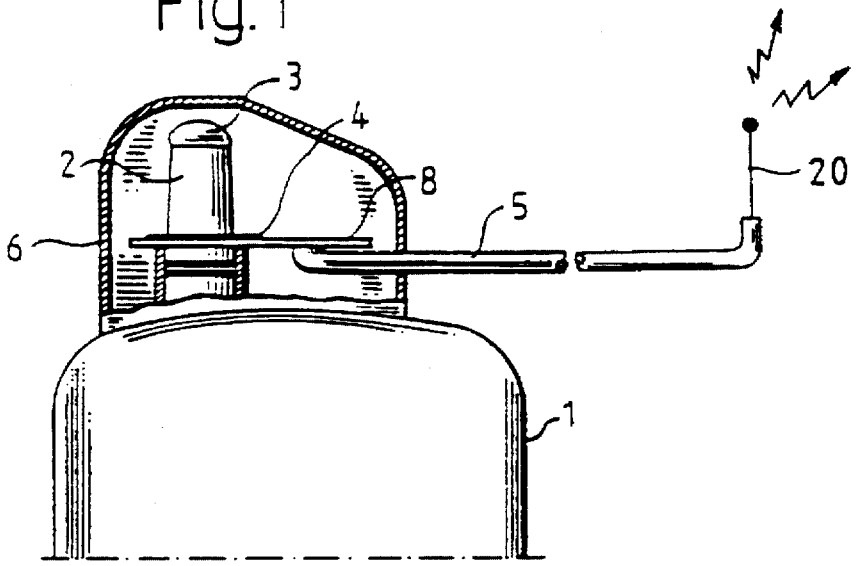
FIG. 1 shows, in a partly cut away side view, a hand-portable telephone provided with a helical antenna, whereon an antenna coupling device according to the invention is applied.

The hand-portable telephone shown in FIG. 1 is provided with two antenna means, one of which is a helical antenna, constituting a first antenna, and the other of which is an extendable and retractable antenna rod. The helical antenna is moulded into a substantially cylindrical element 2 projecting outward from the chassis 1 of the telephone. FIG. 1 shows only an upper knob 3 of the antenna rod which is retracted through the helical antenna.

Further, an antenna coupling device according to the invention is shown. This includes a loop antenna 4 with an impedance matching unit arranged on a printed circuit board within a housing 6, which is made of a non-conductive shell with a substantially cylindrical opening on the underside adapted for receiving the substantially cylindrical element 2 of the helical antenna. The loop antenna 4, which is fixed in the housing 6, coaxially with the substantially cylindrical opening, has am inner diameter which is slightly greater than the diameter of the substantially cylindrical element 2.

One end of a coaxial cable 5, which extends substantially perpendicularly to the axis of the loop antenna 4, is coupled to the loop antenna 4 and the impedance matching unit of the antenna coupling device. The other end of the coaxial cable 5 is connected to a second antenna 20, shown schematically in FIG. 1, mounted externally on the body of the vehicle, on the outside of the building or similarly. Preferably, the second antenna 20 is a monopole antenna or a colinear antenna.

Figure 2:
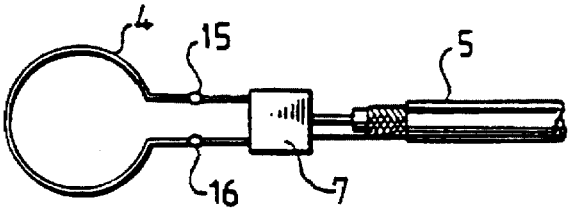
FIG. 2 shows, in a top view, a principle plan of the main components of the antenna coupling device of FIG. 1.

The principle plan of FIG. 2 shows the electrically active components of the antenna coupling device of FIG. 1. The loop antenna is a conductive loop with two poles (ends) 15, 16 with an optional number of turns, preferably approximately one turn.

Further, an impedance matching unit 7 is shown, which is a quadripole with passive reactive elements for transformation of impedance. The poles 15, 16 of the loop antenna are connected to the one pair of the poles of the impedance matching unit 7 and the coaxial cable 5 to the other pair.

Figure 3:
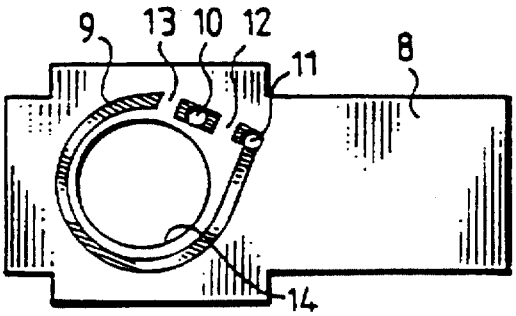
FIG. 3 shows a suitable way of arranging the antenna coupling device of FIG. 1 on a printed circuit board.

FIG. 3 shows the printed circuit board 8, on which the loop antenna 4 (FIG. 1 and 2) and the impedance matching unit 7 (FIG. 2) are arranged. The printed circuit board has a substantially rectangular shape and is provided with a circular hole 14, intended for receiving the first antenna and being offset from the center to the one short side of the rectangle. The printed circuit board is somewhat wider around the hole 14.

The printed circuit board 8 is provided with a first conductor pattern 9 adjacent to the main portion of the periphery of the hole 14, the width of the first conductor pattern 9 being substantially even and considerably smaller than its total length. This conductor pattern constitutes the loop antenna.

At the one end of the first conductor pattern 9 there is provided a hole 11 for connecting the shield of the coaxial cable 5 (FIG. 1 and 2). A second conductor pattern is arranged between the ends of the first conductor pattern 9 and is provided with a hole 10 for connecting the center conductor of the coaxial cable. In the two spaces 12, 13 present between the ends of the conductor patterns reactive components (not shown) forming the impedance matching unit are mounted and connected.

The printed circuit board 8 is fixed inside the housing 6 (FIG. 1) and its right part is used for fixing the cable.

I claim:

1. An antenna coupling device for providing RF energy coupling, substantially inductively, between a first antenna included in a hand-portable telephone, and a second antenna remotely located with respect to the telephone, said antenna coupling device comprising a transmission line having first and second ends, the first end being connected to a loop antenna with two poles, said loop antenna being arranged to surround the first antenna, the second end of said transmission line being connected to the second antenna.

2. The antenna coupling device according to claim 1, wherein the loop antenna is connected to the first end of the transmission line via an impedance matching unit, which is coupled to the loop antenna.

3. The antenna coupling device according to claim 2, wherein the impedance matching unit is arranged so as to match an impedance of the loop antenna to an impedance of the transmission line.

4. The antenna coupling device according to claim 2, wherein the loop antenna and the impedance matching unit are arranged inside a housing that is threadedly connectable onto the first antenna.

5. The antenna coupling device according to claim 4, wherein the housing is provided with at least one mechanical fixing means for fastening on the first antenna.

6. The antenna coupling device according to claim 4 or 5, wherein the housing includes means for aligning said loop antenna substantially coaxially with the first antenna.

7. The antenna coupling device according to claim 2, wherein the loop antenna and the impedance matching unit are arranged on at least one printed circuit board.

8. The antenna coupling device according to claim 1, wherein the transmission line is a coaxial cable.

9. The antenna coupling device according to claim 1, wherein the loop antenna is impedance matched through its length.

10. The antenna coupling device according to claim 1, wherein the loop antenna is arranged for inductive coupling to the first antenna, said first antenna being a helical antenna.

11. The antenna coupling device according to claim 1, wherein the second antenna is a monopole antenna.

12. The antenna coupling device according to claim 1, wherein the loop antenna surrounds the first antenna substantially coaxially with a small radial separation.

13. The antenna coupling device according to claim 1, wherein the second antenna is a dipole antenna.

14. The antenna coupling device according to claim 1, wherein the second antenna is a colinear antenna.

* * * * *